US012180836B2

(12) United States Patent
Xu et al.

(10) Patent No.: US 12,180,836 B2
(45) Date of Patent: Dec. 31, 2024

(54) TESTING DEVICE FOR MULTIPLE PISTON ASSEMBLY OF CAM-LOBE HYDRAULIC MOTOR AND TESTING METHOD

(71) Applicant: ZHEJIANG UNIVERSITY, Zhejiang (CN)

(72) Inventors: Bing Xu, Hangzhou (CN); Xiaolong Zhang, Hangzhou (CN); Huaizhi Zong, Hangzhou (CN); Junhui Zhang, Hangzhou (CN); Chao Zhang, Hangzhou (CN); Yiming Yue, Hangzhou (CN); Danghui Wang, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 18/648,454

(22) Filed: Apr. 28, 2024

(65) Prior Publication Data

US 2024/0280021 A1 Aug. 22, 2024

Related U.S. Application Data

(63) Continuation of application No. PCT/CN2023/082951, filed on Mar. 22, 2023.

(30) Foreign Application Priority Data

Dec. 14, 2022 (CN) ..... 202211602491.8

(51) Int. Cl.
*F01B 31/12* (2006.01)

(52) U.S. Cl.
CPC ..... *F01B 31/12* (2013.01)

(58) Field of Classification Search
CPC ..... F01B 31/12
See application file for complete search history.

(56) References Cited

U.S. PATENT DOCUMENTS 4,798,086 A * 1/1989 Styfhoorn ..... F04B 51/00 73/168
5,908,982 A * 6/1999 Walsh ..... F04B 51/00 73/116.05
2015/0107329 A1 4/2015 Conley et al.

FOREIGN PATENT DOCUMENTS

CN 101413838 A 4/2009
CN 110332106 A 10/2019
(Continued)

OTHER PUBLICATIONS

International Search Report (PCT/CN2023/082951); Date of Mailing: Aug. 4, 2023.
(Continued)

*Primary Examiner* — Eric S. McCall
(74) *Attorney, Agent, or Firm* — W&G Law Group

(57) ABSTRACT

The present application discloses a testing device and a testing method for multiple piston assembly of a cam-lobe hydraulic motor. N cylinder blocks are installed on the cylinder block base, and piston assemblies to be tested are installed on the cylinder blocks. A driving plate is installed on the cylinder block base, and N uniformly-distributed driving plate clamping grooves are formed in the driving plate. A cylinder block protrusion is arranged at the bottom of each cylinder block, and the cylinder block protrusions are clamped in the driving plate clamping grooves. When the driving plate is rotated, the N driving plate clamping grooves drive the N cylinder blocks to rotate synchronously through the cylinder block protrusions, to synchronously change the pressure angle between a driving shaft and each piston assembly.

5 Claims, 6 Drawing Sheets

(56) References Cited

FOREIGN PATENT DOCUMENTS

| | | | |
|---|---|---|---|
| CN | 110425124 | A | 11/2019 |
| CN | 110806289 | A | 2/2020 |
| CN | 114199707 | A | 3/2022 |
| CN | 114993867 | A | 9/2022 |
| CN | 115112370 | A | 9/2022 |
| CN | 115615686 | A | 1/2023 |
| JP | 2009222574 | A | 10/2009 |
| RU | 32602 | U1 | 9/2003 |

OTHER PUBLICATIONS

Notice Of Allowance(CN202211602491.8 ); Date of Mailing: Feb. 25, 2023.

Analysison-Dynamic-Experimental-System-of-Lubrication-Film-Properties-of-Friction-Pairsin-Axial-Piston-Pump, Hua et al. Jul. 2006.

Review-of-Wear-Analyses-Research-for-Main-Moving-Pairs-in-Hydraulic-Axial-Piston-Pump, Ma et al., Aug. 2017.

Research-on-wear-prediction-of-pistoncylinder-pair-in-axial-piston-pumps, Lyu et al. Mar. 2020.

Simulation-and-experimental-investigation-on-low-wear-rate-surface-contour-of-piston/cylinder-pair-in-an-axial-piston-pump, Zhang et al., Jun. 2021.

Multi-technical-analysis-of-wear-mechanisms-in-axial-piston-pumps, Schuhler et al. Journal of Physics: Conf, 2017.

Development-of-a-new-friction-and-wear-test-bench-for-slipper-friction-pair-of-plunger-hydraulic-pump, Machine, Design, and Manufacture, Apr. 1999.

* cited by examiner

TESTING DEVICE FOR MULTIPLE PISTON ASSEMBLY OF CAM-LOBE HYDRAULIC MOTOR AND TESTING METHOD

CROSS-REFERENCE TO RELATED APPLICATIONS

The present application is a continuation of International Application No. PCT/CN2023/082951, filed on Mar. 22, 2023, which claims priority to Chinese Application No. 202211602491.8, filed on Dec. 14, 2022, the contents of both of which are incorporated herein by reference in their entireties.

TECHNICAL FIELD

The present disclosure relates to the technical field of key parts testing of a hydraulic motor and, in particular, to a testing device for a multiple piston assembly of a cam-lobe hydraulic motor and a testing method.

BACKGROUND

Cam-lobe hydraulic motors have the advantages of a small volume, a light weight, a low pulsation, a high starting efficiency and stable operation at a very low speed, and thus are widely used in various transmission devices with low speed and high torque. Cam-lobe hydraulic motors can achieve a lower rotational speed without using a gearbox to reduce the speed, which saves the cost of the reducer, such that the whole transmission device is more compact in structure and more convenient to be installed.

During the working process of the cam-lobe hydraulic motor, the roller-piston sliding friction pair in a piston assembly is often in a state of mixed or boundary lubrication under the high pressure and low speed conditions, which causes the sliding friction pair to be easily worn out. In order to analyze the failure mechanism of the sliding friction pair and verify the effectiveness of the optimization and improvement solution, it is necessary to test the sliding friction pairs. However, the commonly used testing method at present is to test the motor as a whole, and then disassemble the motor to observe the wear of the roller-piston sliding friction pair in the piston assembly. However, this method has a long test period, high test cost and difficulty in motor disassembly. Therefore, it is of great significance to design a quasi-actual testing device for a piston assembly in a cam-lobe hydraulic motor for motor failure analysis and optimization design.

SUMMARY

The object of the present application is to provide a testing device and a testing method for a multiple piston assembly of a cam-lobe hydraulic motor to solve the shortcomings of the prior art.

The object of the present application is realized by the following technical solution: a testing device for a multiple piston assembly of a cam-lobe hydraulic motor; the device includes a driving plate, a driving shaft, cylinder blocks, a central shaft, a cylinder block base, a motor and a rotating speed and torque sensor.

The motor, the rotating speed and torque sensor and the driving shaft are coaxially connected in turn, and the driving shaft passes through a center of the cylinder block base and is rotationally connected with the cylinder block base.

N cylinder blocks are uniformly arranged on the cylinder block base along a circumferential direction.

One side of the central shaft passes through the cylinder blocks and is rotatably connected with the cylinder blocks, and the other side is fixed on the cylinder block base.

The driving plate is installed on the cylinder block base and is capable of rotating around a mounting hole of the driving shaft of the cylinder block base; N driving plate clamping grooves are evenly distributed along a circumference, and a bottom of each cylinder block is provided with a cylinder block protrusion; each cylinder block protrusion is clamped in the driving plate clamping groove at a corresponding position and is connected with the driving plate clamping groove in a sliding manner; when the driving plate is rotated, the N driving plate clamping grooves drive the N cylinder blocks, through the cylinder block protrusions, to rotate synchronously around respective central shafts of the N cylinder blocks, so as to change a pressure angle between the driving shaft and a piston assembly on the cylinder block.

The cylinder block is provided with a fixing bolt, which is used for fixing the cylinder block on the cylinder block base during testing to limit the rotation of the cylinder block.

The cylinder block is provided with a piston hole, and the piston assembly to be tested is installed in the piston hole.

Further, an arc chute is provided at a position corresponding to the bottom of each cylinder block on the cylinder block base, and a center of a central arc line of the arc chute is located on an axis of a corresponding cylinder block central shaft; and the fixing bolt on the cylinder block passes through the arc chute, and the fixing bolt slides in the arc chute when the cylinder block rotates.

Further, N cylinder block central shafts are evenly distributed around the mounting hole of the driving shaft on the cylinder block base, and the distances between the N cylinder block central shafts and the mounting hole of the driving shaft are equal.

Further, the pressure angle is an acute angle between a connecting line between a center of the driving shaft and a center of a roller in the piston assembly and a piston axis, and the pressure angle represents a direction of a force acting on the pin roller by the driving shaft.

In another aspect, the present application further provides a testing method for a multiple piston assembly of a cam-lobe hydraulic motor, wherein the method specifically includes the following steps:

(1) Loosening fixing bolts on the N cylinder blocks, and installing the piston assemblies of the N cylinder blocks to be tested into the piston holes of the cylinder blocks, so that the central axes of the pin rollers in the piston assemblies are parallel to the central axis of the driving shaft.

(2) Rotating the driving plate to drive the N cylinder blocks to rotate synchronously around respective central shafts thereof, adjusting the pressure angle between the driving shaft and the pin rollers to a desired value, and tightening the fixing bolts to fix the N cylinder blocks on the cylinder block base after the driving plate is adjusted.

(3) Supplying hydraulic oil to a piston cavity on the cylinder block through an oil port joint, and pressing the pin roller, by a piston, on the driving shaft under the action of the hydraulic oil, so as to change a pressure of the hydraulic oil to change the magnitude of an acting force between the pin roller and the driving shaft and adjust a temperature of the hydraulic oil to a desired value.

(4) Driving the driving shaft to rotate by the motor, and the driving shaft further driving the pin roller to rotate, so as to adjust a rotating speed of the motor and change a rotating speed of the pin roller in the piston assembly.

(5) Monitoring changes of the pressure and the temperature of the hydraulic oil in the piston cavity of the cylinder block by a temperature and pressure sensor, and recording a change of a friction torque between the pin roller and the piston in the piston assembly by the rotating speed and torque sensor; after a test, comparing wear degrees of sliding friction pairs between the pin rollers and the pistons in the piston assemblies and frictional forces recorded by the rotating speed and torque sensor, wherein the piston assembly with lower frictional force and lighter wear is superior.

The testing device for a multiple piston assembly of a cam-lobe hydraulic motor provided by the present application can be used to test a plurality of piston assemblies at the same time, so that the influence of different structures, materials, coatings and the like of the pistons or pin rollers on the wear state of the sliding friction pair between the pin roller and the piston can be comparatively tested; by rotating the driving plate, each cylinder block can be synchronously rotated, so as to synchronously change the pressure angles of the piston assemblies to be tested on respective cylinder blocks, and ensure that the pressure angles on respective piston assemblies are the same (the acting directions of the forces are the same); simultaneous testing and the same pressure angle ensure that the testing conditions of respective piston assemblies to be tested are the same, and the results of comparative testing are more accurate and credible. At the same time, in the testing process, because the cylinder blocks and the piston assemblies thereof are evenly distributed around the driving shaft, and the pressure angles on respective piston assemblies are equal, the forces of all piston assemblies to be tested on the driving shaft are in a balanced state, thus greatly prolonging the service life of the testing device. In addition, by changing the pressure angle of the piston assembly, the pressure and temperature of the hydraulic oil, and the rotation speed of the pin roller, the running states of the piston assembly under different working conditions of the motor can be simulated more realistically. Moreover, compared with testing and disassembling the whole motor, the installment and disassembly of the piston assembly in the testing device are easier, the testing process is simpler, and the testing time cost is lower.

Figure 1:
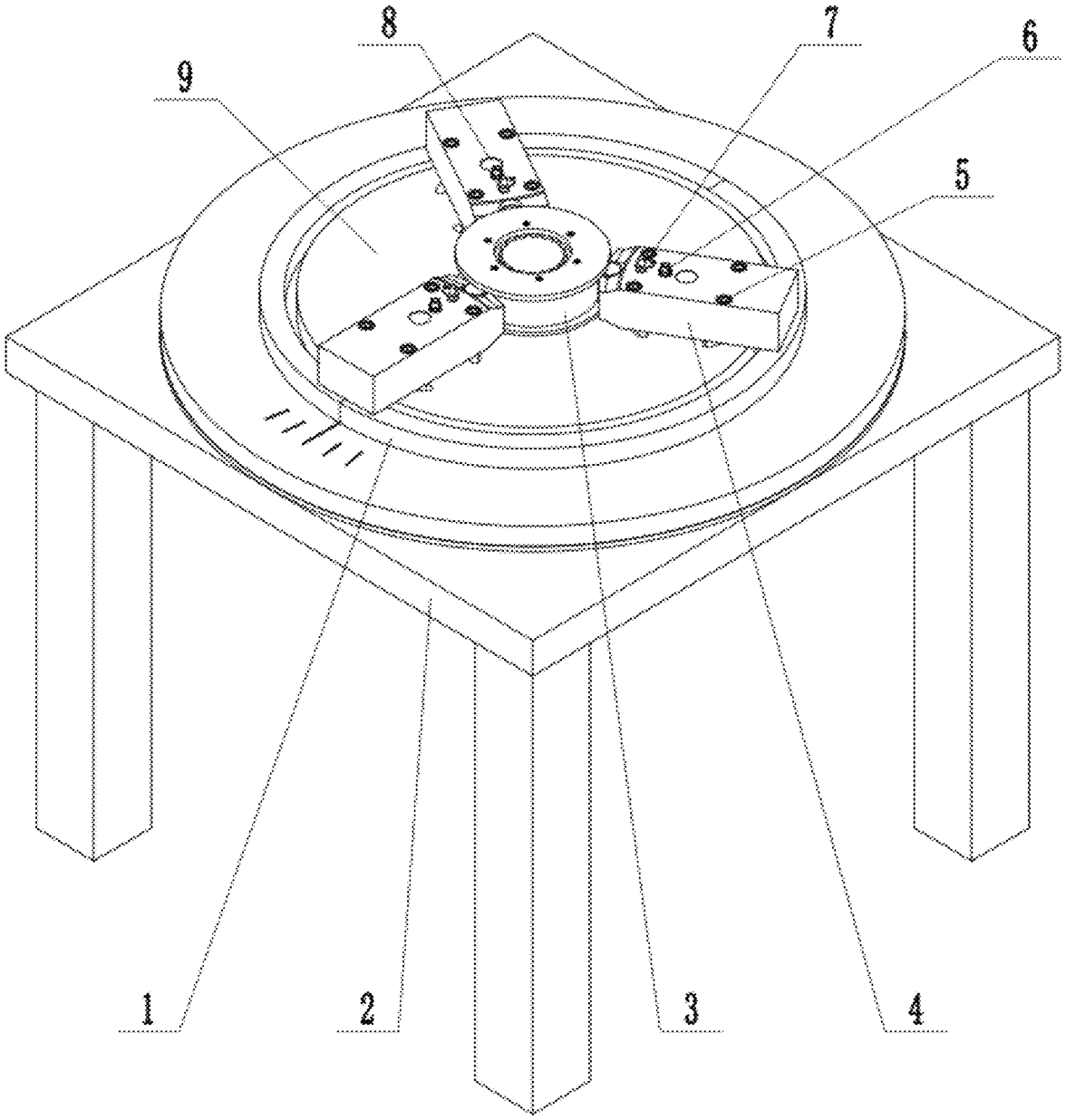
FIG. 1 is an axonometric drawing of a testing device for a multiple piston assembly of a cam-lobe hydraulic motor.

The reference signs in the drawings are: 1—Driving plate, 2—Bracket, 3—Driving shaft, 4—Cylinder block, 4.1—Cylinder block protrusion, 5—Fixing bolt, 6—Oil port joint, 7—Sensor, 8—Central shaft, 9—Cylinder block base, 10—Motor, 11—Rotating speed and torque sensor, 12—Piston assembly, 12.1—Pin roller, 12.2—Piston, 13—Rotation center hole, 14—Indicator scale, 15—Chute, 16—Driving shaft mounting hole, and 17—driving plate clamping groove.

DESCRIPTION OF EMBODIMENTS

In order to explain the embodiments of the present application more clearly, the present application will be further explained with reference to the attached drawings and specific embodiments.

As shown in FIG. 1, the testing device for a multiple piston assembly of a cam-lobe hydraulic motor proposed by the present application, in particular to a testing device for a three-piston assembly of a cam-lobe hydraulic motor, includes a driving plate 1, a bracket 2, a driving shaft 3, a cylinder block 4, a fixing bolt 5, an oil port joint 6, a temperature and pressure sensor 7, a central shaft 8, a cylinder block base 9, a motor 10 and a rotating speed and torque sensor 11.

Figure 2:
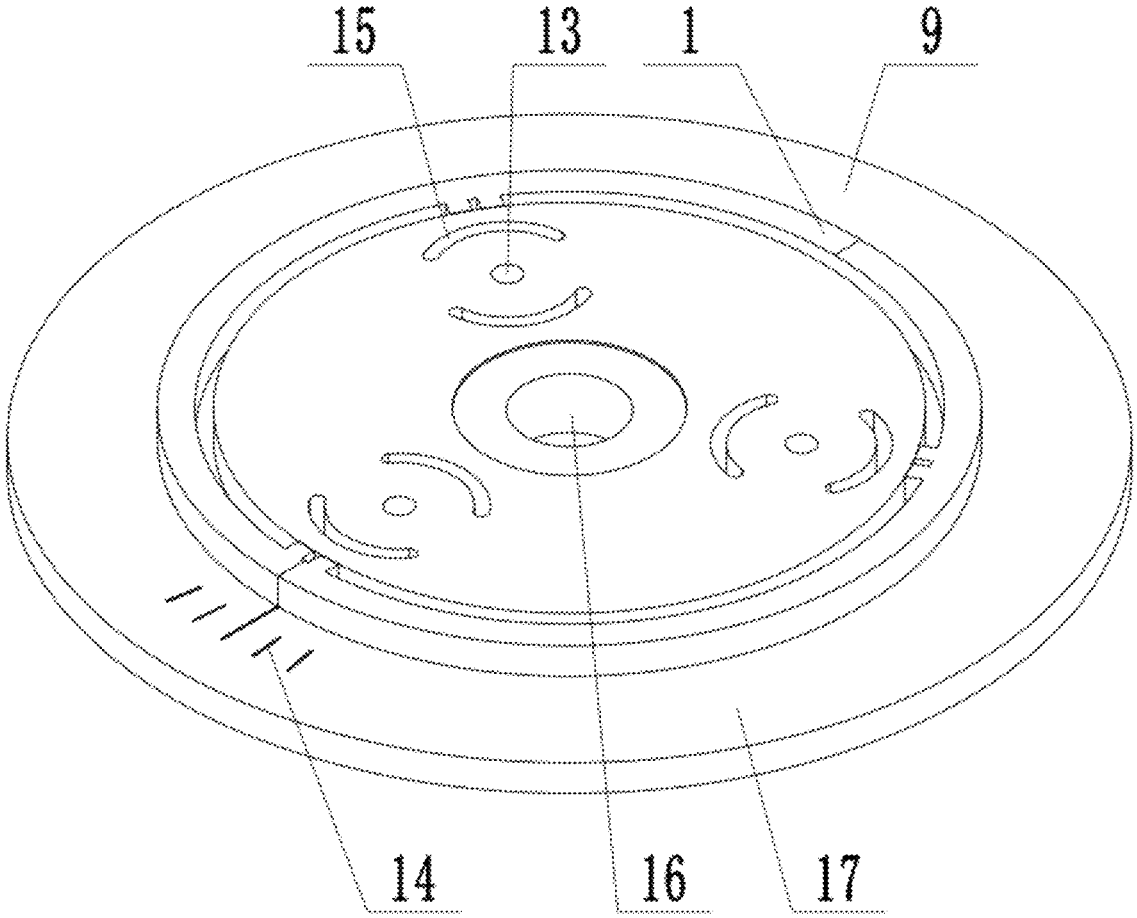
FIG. 2 is an axonometric drawing of the cylinder block base and the driving plate.

As shown in FIGS. 1 and 2, the cylinder block base 9 is fixed on the bracket 2, and the cylinder block base 9 is provided with a driving shaft mounting hole 16, which is coaxial with the cylinder block base 9; the driving motor 10, the rotating speed and torque sensor 11 and the driving shaft 3 are coaxially connected in turn, and the driving shaft 3 passes through the driving shaft mounting hole 16.

As shown in FIG. 2, the cylinder block base 9 has a cylindrical step structure, and the central axis of the cylindrical step coincides with the central axis of the driving shaft mounting hole 16; there are three rotation center holes 13 on the cylindrical step, and the three rotation center holes 13 are evenly distributed around the driving shaft mounting hole 16; the distances between the three rotation center holes 13 and the driving shaft mounting hole 16 are all equal.

Figure 3:
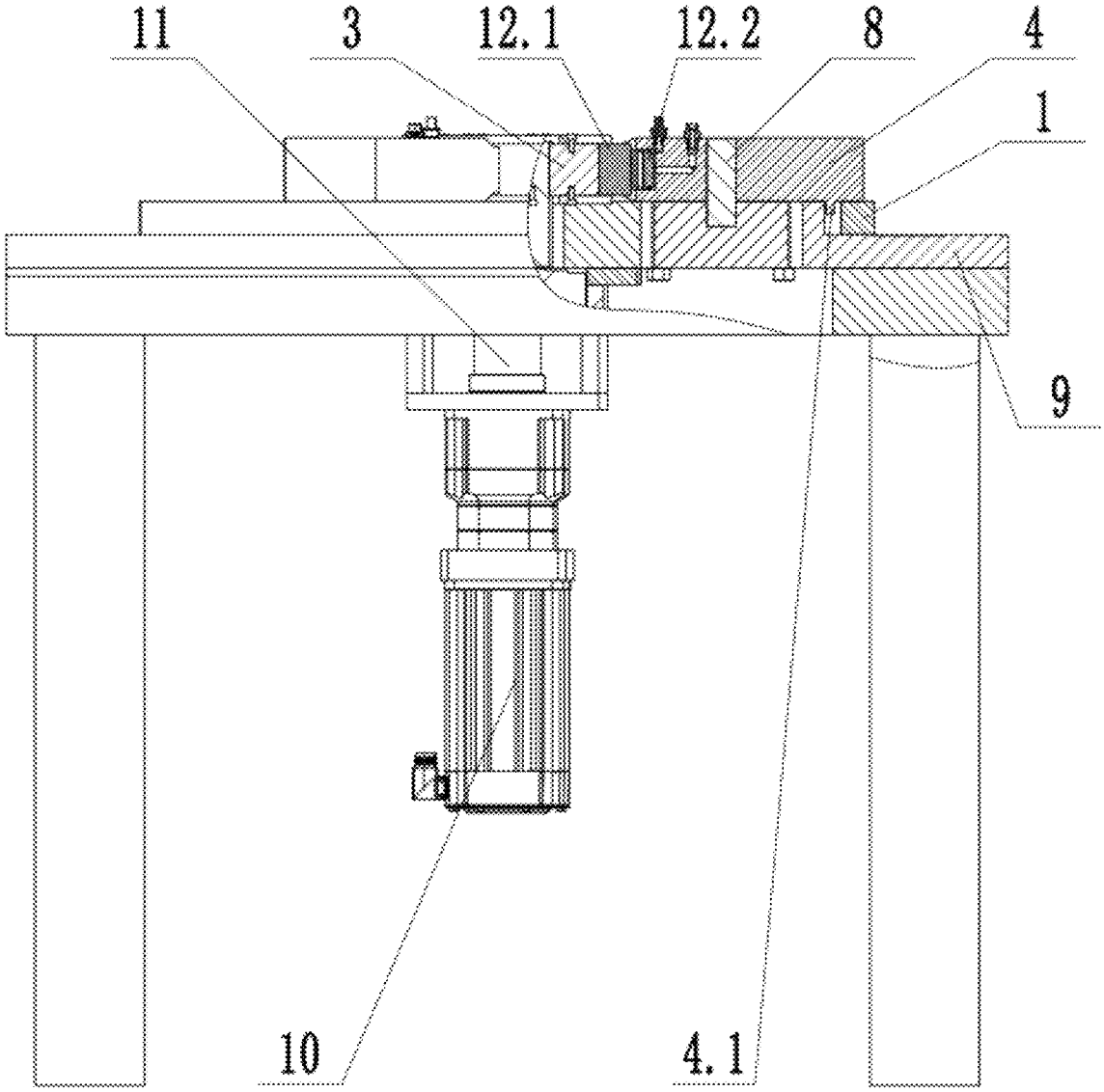
FIG. 3 is the left side view of the testing device for a multiple piston assembly of a cam-lobe hydraulic motor.

As shown in FIGS. 1 and 3, three cylinder blocks 4 are installed on the cylindrical step of the cylinder block base 9.

One end of the central shaft 8 passes through the cylinder block 4, and the cylinder block 4 can rotate around the central shaft 8; the other end is inserted into the rotation center hole 13 on the cylinder block base 9; the three cylinder blocks 4 correspond to the three rotation center holes 13 and the three central shafts 8, respectively.

As shown in FIG. 2, the driving plate 1 is installed on the cylinder block base 9, and the cylindrical step on the cylinder block base 9 passes through the driving plate 1. Three driving plate clamping grooves 17 are distributed on the driving plate 1 at equal intervals, and the ends of the three driving plate clamping grooves 17 facing the center just abut against the cylindrical surface of the cylindrical step of the cylinder block base 9, so as to limit the horizontal movement of the driving plate 1 and ensure that the driving plate 1 is always concentric with the driving shaft mounting hole 16 at the center of the cylindrical step; the driving plate 1 can only rotate around the driving shaft mounting hole 16 of the cylinder block base 9.

Figure 4:
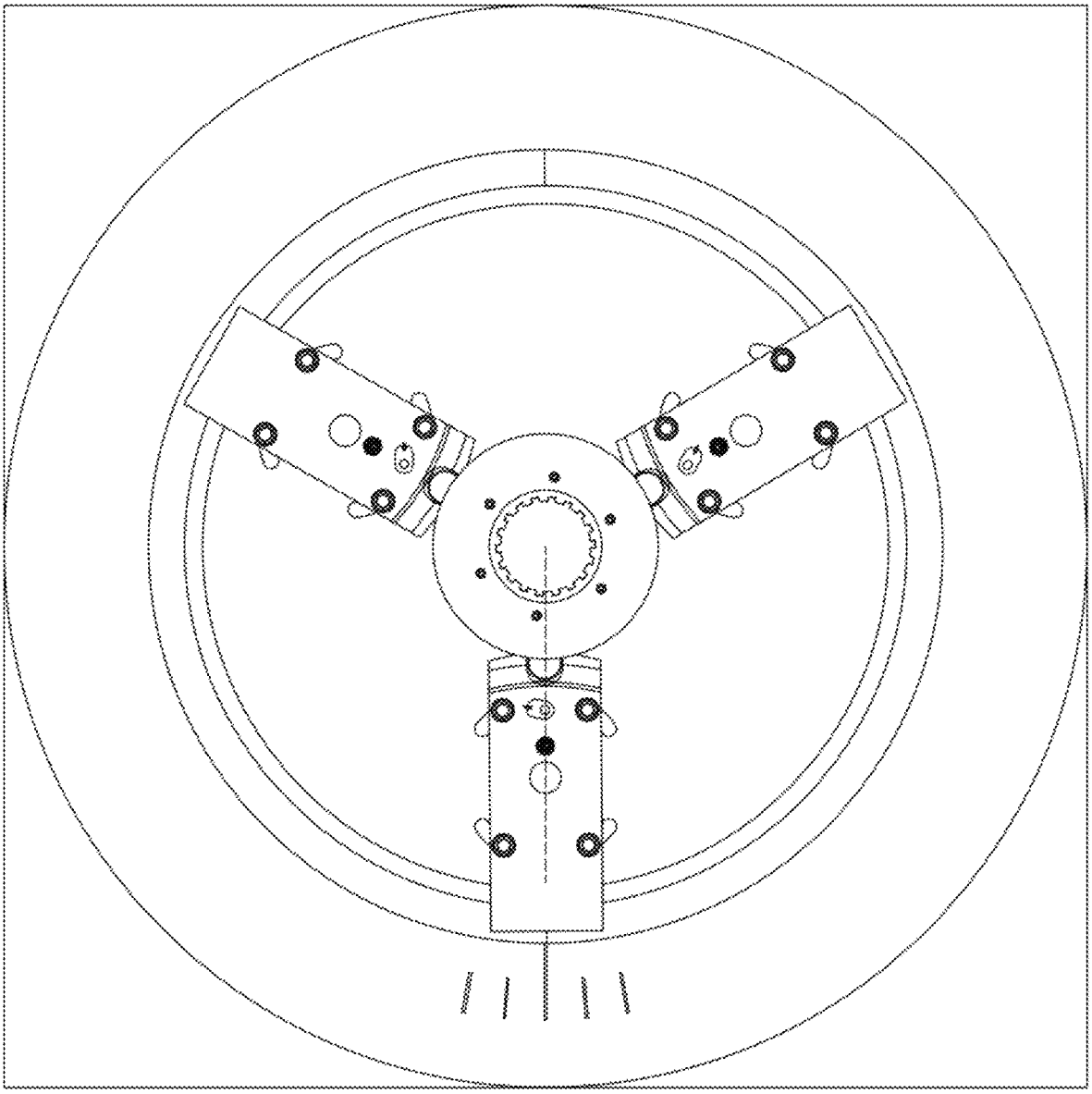
FIG. 4 is a top view of the testing device for a multiple piston assembly of a cam-lobe hydraulic motor when the driving plate rotates by 0 degrees.
Figure 5:
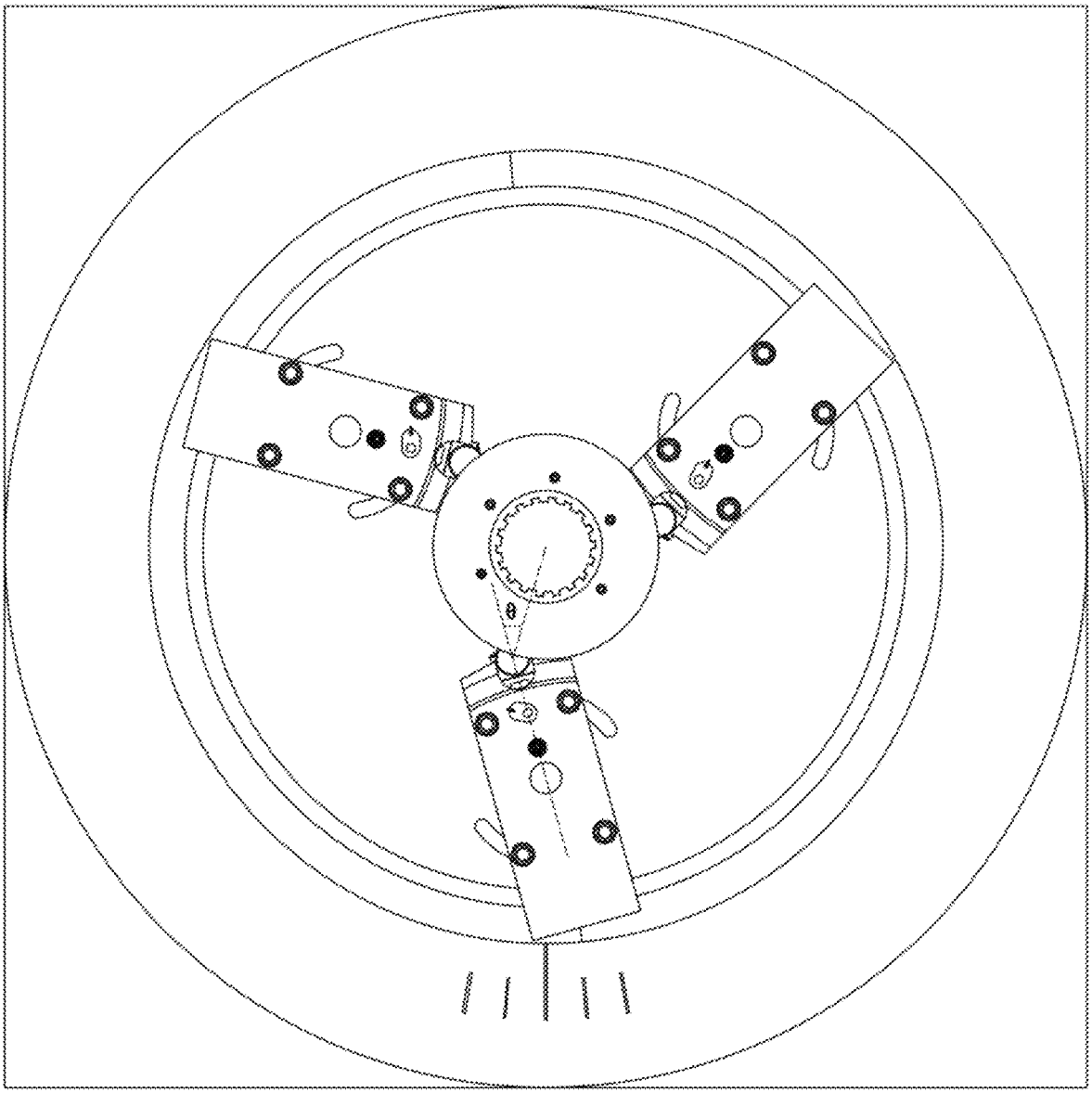
FIG. 5 is a top view of the testing device for a multiple piston assembly of a cam-lobe hydraulic motor when the driving plate rotates by θ degrees.

As shown in FIG. 3, each cylinder block 4 is provided with a cylinder block protrusion 4.1; each cylinder block protrusion 4.1 is stuck in a driving plate clamping groove 17. The driving plate 1 is rotated, and the three driving plate clamping grooves 17 drive the three cylinder blocks 4 to rotate synchronously around their respective central shafts 8 through the cylinder block protrusions 4.1, as shown in FIGS. 4 and 5, so as to ensure that the pressure angles on various piston assemblies 12 are equal. During the rotation, the cylinder block protrusion 4.1 slides in the driving plate clamping groove 17 to ensure that the cylinder block 4 can rotate with the driving plate 1.

As shown in FIG. 5, the pressure angle is the acute angle θ between the connecting line from the center of the driving shaft 3 to the center of the pin roller 12.1 and the piston axis; the pressure angle is used to indicate the direction of the force acting on the pin roller by the driving shaft.

The cylinder block 4 is provided with a fixing bolt 5, and the cylinder block 4 can be fixed on the cylinder block base 9 by tightening the fixing bolt 5, so as to limit the rotation of the cylinder block 4 in the testing process; an indicator scale 14 is provided on the cylinder block base 9 to indicate the angle at which the driving plate 1 drives the three cylinder blocks 4 to rotate synchronously.

The uniform distribution of the central holes 13 and the driving plate clamping grooves 17 is to ensure that the forces acting on the driving shaft 3 by the three piston assemblies 12 are balanced.

The rotating center hole 13 is a blind hole; there are two arc chutes 15 around each rotation center hole 13 on the cylinder block base, and the central arc lines of the two arc chutes 15 are concentric with the corresponding rotation center hole 13.

The fixing bolts 5 pass through the chutes 15, and the fixing bolts 5 can slide along the corresponding chutes 15 during the rotation of the three cylinder blocks 4 by the driving plate 1.

Figure 6:
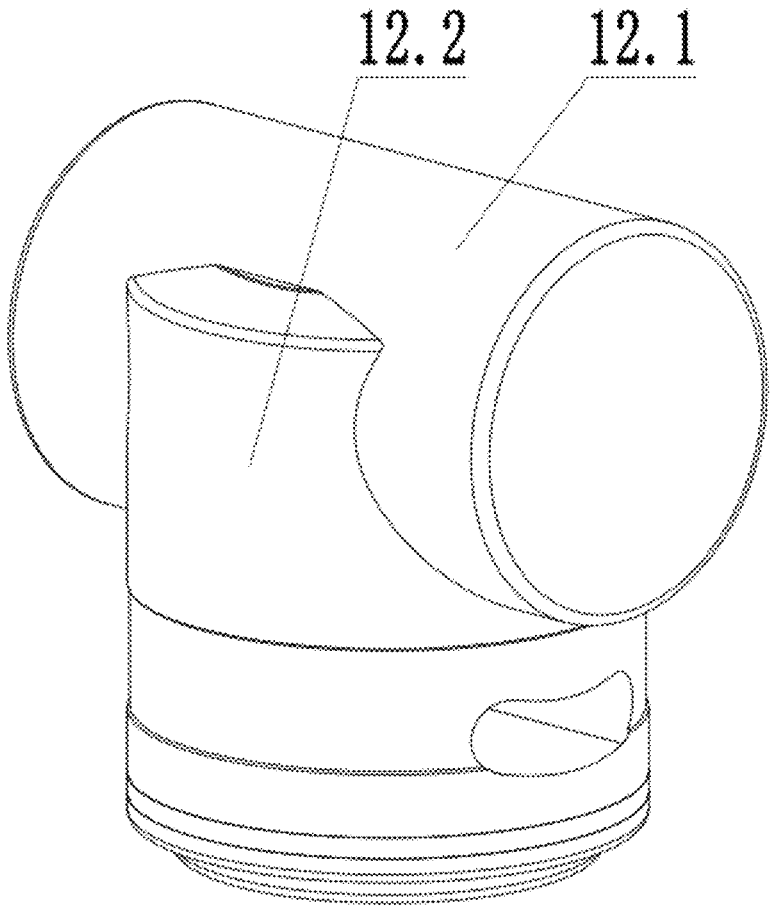
FIG. 6 is an axonometric drawing of the piston assembly to be tested.

As shown in FIG. 6, the piston assembly 12 to be tested is composed of a pin roller 12.1 and a piston 12.2. The pin roller 12.1 can rotate around its own axis, and the pin roller is installed in a cylindrical hole on the piston. The central axis of the pin roller is perpendicular to the central axis of the piston, and the pin roller and the piston slide relatively to form a sliding friction pair with the piston 12.2. As shown in FIG. 3, the piston assembly 12 to be tested is installed in the piston hole of the cylinder block 4, and the cylinder block 4 is equipped with an oil port joint 6 and a temperature and pressure sensor 7, which are communicated with the piston cavity. Hydraulic oil can be supplied to the piston cavity between the piston 12.2 and the cylinder block 4 through the oil port joint 6, and the temperature and pressure of the oil in the piston cavity are collected by the sensor. The hydraulic oil presses the pin roller 12.1 on the driving shaft 3 through the piston 12.2, and the central axis of the pin roller 12.1 is parallel to the central axis of the driving shaft 3, which drives the pin rollers 12.1 in the three piston assemblies 12 to be tested to rotate when the driving shaft 3 rotates.

Corresponding to the embodiment of the testing device for a multiple piston assembly of a cam-lobe hydraulic motor, the present application also provides a testing method using the testing device for the roller-piston friction pair of the cam-lobe hydraulic motor, which includes the following steps:

(1) Three piston assemblies 12 are prepared, and only the piston 12.2 in the three piston assemblies 12 adopts different surface strengthening methods, specifically, diamond-like carbon coating, molybdenum disulfide coating and salt bath surface nitriding, and other parameters in the three piston assemblies 12 remain the same; through this testing device, the effects of three surface strengthening methods on the wear resistance of piston 12.2 in piston assembly 12 are compared and tested; the fixing bolts 5 on the cylinder block 4 are loosened, and the three piston assemblies 12 to be tested are installed into the piston holes of the three cylinder blocks 4, so that the central axis of the pin roller 12.1 is parallel to the central axis of the driving shaft 3.

(2) According to the actual working condition of the piston assemblies 12 to be simulated, the pressure angle θ is determined, the driving plate 1 is rotated, and the driving plate 1 drives the three cylinder blocks 4 to rotate synchronously around their respective central shafts 8; and according to the pressure angle θ, the indicator line on the driving plate 1 is turned to the corresponding position of the indicator scale 14, and the fixing bolts 5 are tightened to fix the cylinder blocks 4 on the cylinder block base 9 after adjustment.

(3) According to the actual working condition of the piston assemblies 12 to be simulated, hydraulic oil with the required pressure and temperature is supplied to the piston cavities of the three cylinder blocks 4 through the oil port joint 6, and the hydraulic oil states in the piston cavities of the three cylinder blocks 4 are consistent; the piston 12.2 presses the pin roller 12.1 on the driving shaft 3 under the action of hydraulic oil; the pressure of hydraulic oil is changed to change the magnitude of the force between the pin roller and the driving shaft.

(4) The motor 10 drives the driving shaft 3 to rotate, and the driving shaft 3 further drives the three pin rollers 12.1 to rotate; the rotating speed of the motor 10 is adjusted to the required value according to the actual working condition of the piston assembly 12 to be simulated.

(5) The test bench is allowed to run continuously, the pressure and temperature changes of hydraulic oil in the piston cavity of the cylinder block 4 are monitored by the sensor 7, and the change of friction between the pin roller 12.1 and the piston 12.2 is monitored through the rotating speed and torque sensor 11; the test is stopped after 10 hours of testing, the three piston assemblies 12 are dismantled, and the wear state of the sliding friction pair between the pin roller 12.1 and the piston 12.2 in the piston assembly 12 is observed and obtained; in the test results of three kinds of pistons 12.2, the wear conditions of the three processes are different, and the wear of the piston 12.2 with the salt bath surface nitriding process is the lightest; at the end of the comparison, as for the frictional forces respectively measured for the three piston assemblies 12, the piston 12.2 with the salt bath surface nitriding process is also the smallest; therefore, the salt bath surface nitriding process has a better wear resistance.

The above-mentioned embodiments are only intended to describe the preferred embodiments of the present application, and do not limit the scope of the present application. Under the premise of not departing from the design spirit of the present application, various modifications and improvements made by those skilled in the art to the technical solutions of the present application shall fall within the protection scope determined by the claims of the present application.

What is claimed is:

1. A testing device for a multiple piston assembly of a cam-lobe hydraulic motor, comprising a driving plate, a driving shaft, cylinder blocks, a central shaft, a cylinder block base, a motor and a rotating speed and torque sensor;

wherein the motor, the rotating speed and torque sensor and the driving shaft are coaxially connected successively, and the driving shaft passes through a center of the cylinder block base and is rotationally connected with the cylinder block base;

N cylinder blocks are uniformly arranged on the cylinder block base along a circumferential direction;

one side of the central shaft passes through the cylinder blocks and is rotatably connected with the cylinder blocks, and the other side is fixed on the cylinder block base;

the driving plate is installed on the cylinder block base and is capable of rotating around a mounting hole of the driving shaft of the cylinder block base; N driving plate clamping grooves are evenly distributed along a circumference, and a bottom of each cylinder block is provided with a cylinder block protrusion; each cylinder block protrusion is clamped in the driving plate clamping groove at a corresponding position and is connected with the driving plate clamping groove in a sliding manner; when the driving plate is rotated, the N driving plate clamping grooves drive the N cylinder blocks, through cylinder block protrusions, to rotate synchronously around respective central shafts of the N cylinder blocks, in such a manner to change a pressure angle between the driving shaft and a piston assembly on the cylinder block;

the cylinder block is provided with a fixing bolt for fixing the cylinder block on the cylinder block base during testing to limit the rotation of the cylinder block; and the cylinder block is provided with a piston hole, and the piston assembly to be tested is installed in the piston hole.

2. The testing device for a multiple piston assembly of a cam-lobe hydraulic motor according to claim 1, wherein an arc chute is provided at a position corresponding to the bottom of each cylinder block on the cylinder block base, and a center of a central arc line of the arc chute is located on an axis of a corresponding cylinder block central shaft; and the fixing bolt on the cylinder block passes through the arc chute, and the fixing bolt slides in the arc chute when the cylinder block rotates.

3. The testing device for a multiple piston assembly of a cam-lobe hydraulic motor according to claim 1, wherein N cylinder block central shafts are evenly distributed around the mounting hole of the driving shaft on the cylinder block base, and distances between the N cylinder block central shafts and the mounting hole of the driving shaft are equal.

4. The testing device for a multiple piston assembly of a cam-lobe hydraulic motor according to claim 1, wherein the pressure angle is an acute angle between a connecting line between a center of the driving shaft and a center of a pin roller in the piston assembly and a piston axis, and the pressure angle represents a direction of a force acting on the pin roller by the driving shaft.

5. A testing method based on the testing device for a multiple piston assembly of a cam-lobe hydraulic motor according to claim 1, wherein the method comprises:

(1) loosening fixing bolts on the N cylinder blocks, and installing piston assemblies of the N cylinder blocks to be tested into piston holes of the cylinder blocks, in such a manner that central axes of the pin rollers in the piston assemblies are parallel to a central axis of the driving shaft;

(2) rotating the driving plate to drive the N cylinder blocks to rotate synchronously around respective central shafts of the N cylinder blocks, adjusting the pressure angle between the driving shaft and the pin rollers to a desired value, and tightening the fixing bolts to fix the N cylinder blocks on the cylinder block base after the driving plate is adjusted;

(3) supplying hydraulic oil to a piston cavity on the cylinder block through an oil port joint, and pressing the pin roller, by a piston, on the driving shaft under an action of the hydraulic oil, so as to change a pressure of the hydraulic oil to change the magnitude of an acting force between the pin roller and the driving shaft and adjust a temperature of the hydraulic oil to a desired value;

(4) driving, by the motor, the driving shaft to rotate, and driving, by the driving shaft, the pin roller to rotate, so as to adjust a rotating speed of the motor and change a rotating speed of the pin roller in the piston assembly; and (5) monitoring changes of the pressure and the temperature of the hydraulic oil in the piston cavity of the cylinder block by a temperature and pressure sensor, and recording a change of a friction torque between the pin roller and the piston in the piston assembly by the rotating speed and torque sensor; after a test, comparing wear degrees of sliding friction pairs between the pin rollers and pistons in the piston assemblies and frictional forces recorded by the rotating speed and torque sensor, wherein the piston assembly with lower frictional force and lighter wear is superior.

* * * * *